US007393027B1

(12) United States Patent
Chen

(10) Patent No.: US 7,393,027 B1
(45) Date of Patent: Jul. 1, 2008

(54) DOOR STOP

(76) Inventor: Tong-Sin Chen, No. 121, Sinjhong Road, Hemei Township, Changhua County (TW)

( * ) Notice: Subject to any disclaimer, the term of this patent is extended or adjusted under 35 U.S.C. 154(b) by 0 days.

(21) Appl. No.: 11/627,441

(22) Filed: Jan. 26, 2007

(51) Int. Cl.
*E05C 17/44* (2006.01)

(52) U.S. Cl. ..... 292/342; 292/251.5; 16/82

(58) Field of Classification Search ..... 292/DIG. 15, 292/251.5, 342, 343; 16/82, 86 A
See application file for complete search history.

(56) References Cited

U.S. PATENT DOCUMENTS 2,311,278 A * 2/1943 Johnson ..... 16/86 A
3,010,142 A * 11/1961 Ahlquist ..... 16/86 A
5,010,622 A * 4/1991 Morita ..... 16/85
5,836,049 A * 11/1998 Chiang ..... 16/82
6,658,697 B2 * 12/2003 Liao ..... 16/82

* cited by examiner

*Primary Examiner*—Gary Estremsky
(74) *Attorney, Agent, or Firm*—Rabin & Berdo, P.C.

(57) ABSTRACT

A doorstop includes a base secured to a floor; the base containing a buffer in relation to the direction of a door panel; a magnetic member being inserted into the center of the buffer; an elastic member being disposed to the inner end of the magnetic member; the elastic member enabling the buffer to engage in reciprocal compression; and when the door is opened, a door panel contacts the doorstop; impact applied by the door panel being absorbed and offset by a coil disposed to the inner end of the buffer; and the door panel being attracted to the magnetic member to prevent possible bouncing back by the door panel.

6 Claims, 10 Drawing Sheets

DOOR STOP

BACKGROUND OF THE INVENTION (a) Field of the Invention

The present invention is related to a doorstop, and more particularly, to a base containing a buffer with a built-in elastic member to offset impact from closing the door and a magnetic member to prevent the door from bouncing back when slammed.

(b) Description of the Prior Art

A doorstop is usually provided to keep a door in position after it is opened so to facilitate the access. Doorstops generally available in the market include two types, insertion and attachment. The insertion type has an insertion member secured at a pre-determined location on the back of the door while a clamping member is disposed at the doorstop so that when the door is opened, the insertion member enters and is confined by the clamping member to secure the door. A magnet is disposed to the attachment type of the doorstop, and a locating member that can be attracted by the magnetic doorstop is disposed on the back of the door or the locating member may be omitted when the door is made of a material that can be attracted to the magnetic doorstop so to hold the door in its open status.

However, either the insertion or the attachment type of the doorstop does not provide buffer efficacy. When someone slams the door, the door is vulnerable to be damaged, the door fails to be caught by the doorstop, and the door may bounce back due to counterforce to cause safety concerns while creating noise at uncomfortable level.

To solve these problems, an improved structure of doorstop with buffer function by providing an elastic member in a base of the doorstop was introduced. When someone slams the door, the elastic member absorbs partial impact from the door to prevent the door from bouncing back.

However, the impact from the door may be partially absorbed, the door remains pivoting since it is not necessarily secured in position by the doorstop. The access and safety justify further improvement.

SUMMARY OF THE INVENTION

The primary purpose of the present invention is to provide a doorstop that provides buffer and attachment functions to secure the door in its open status while preventing the door from bouncing back at the same time to maintain safety and well-facilitated access.

Another purpose of the present invention is to provide a doorstop that is simple in construction to offer optimal utility in meeting economic benefits.

To achieve these purposes, the present invention is essentially comprised of a base containing a buffer; the buffer includes a magnetic member and an elastic member; and a locating member attached to the back of a door at where that can be attracted to the magnetic member when the door is opened. The locating member may be omitted if the material of the door is attracted to the magnetic member. When the door is slammed, the elastic member offsets the excessive impact by absorption while the magnetic member secures the door in position by attaching to the magnetic member.

DETAILED DESCRIPTION OF THE PREFERRED EMBODIMENTS

Figure 1:
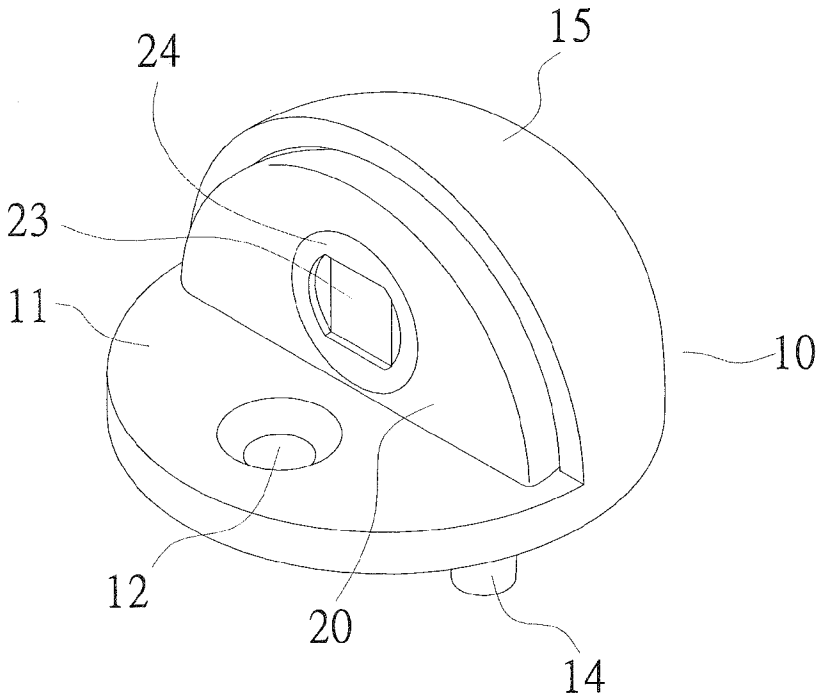
FIG. 1 is a schematic view showing a construction of a preferred embodiment of the present invention.
Figure 3:
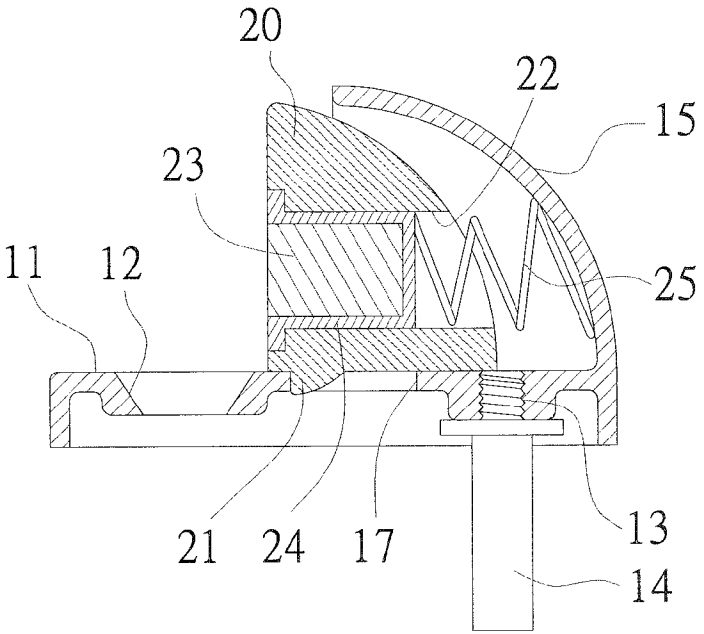
FIG. 3 is a schematic view showing structural relation among members of the preferred embodiment of the present invention.
Figure 2:
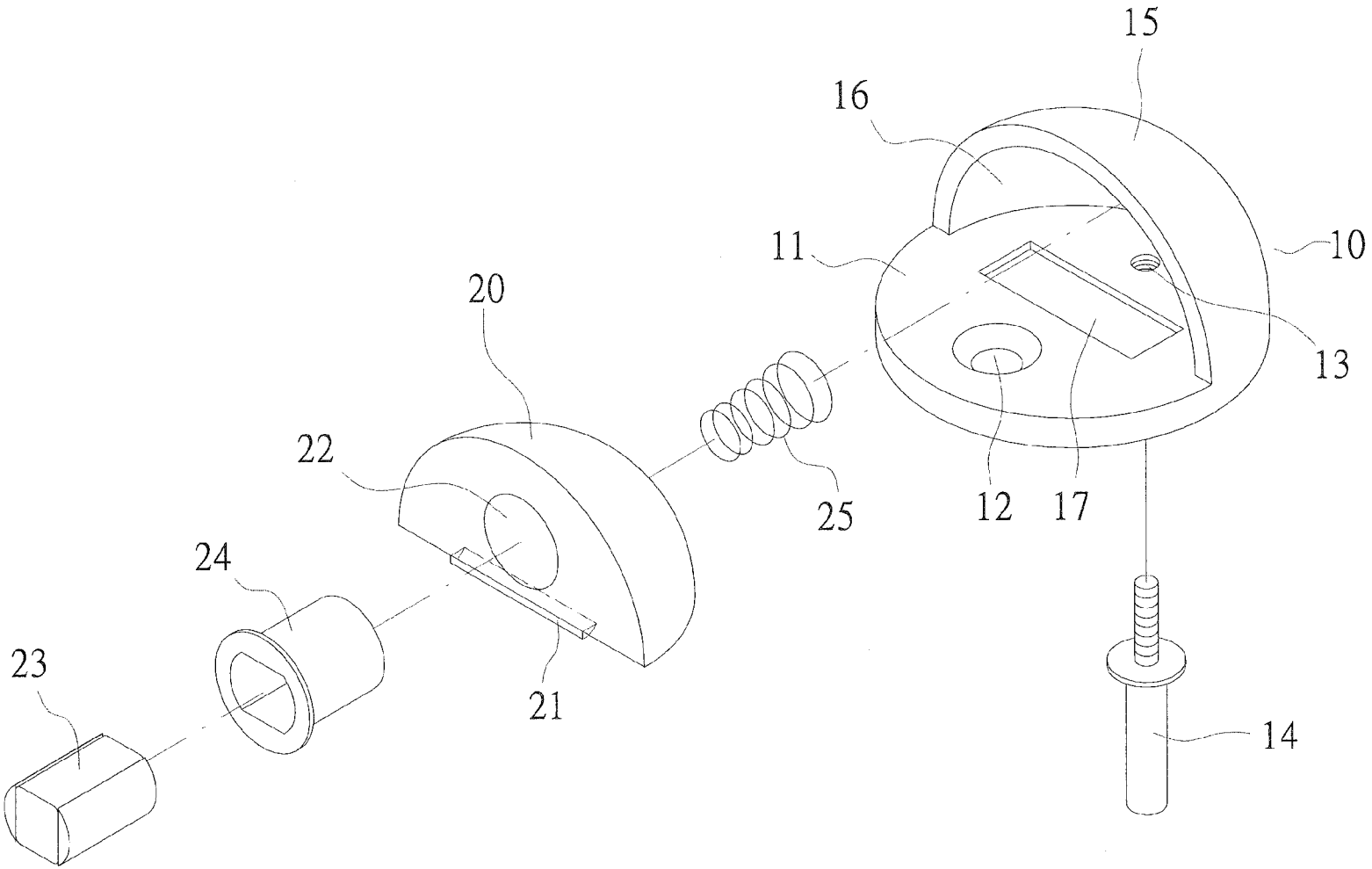
FIG. 2 is an exploded view of the construction of the preferred embodiment of the present invention.
Figure 4:
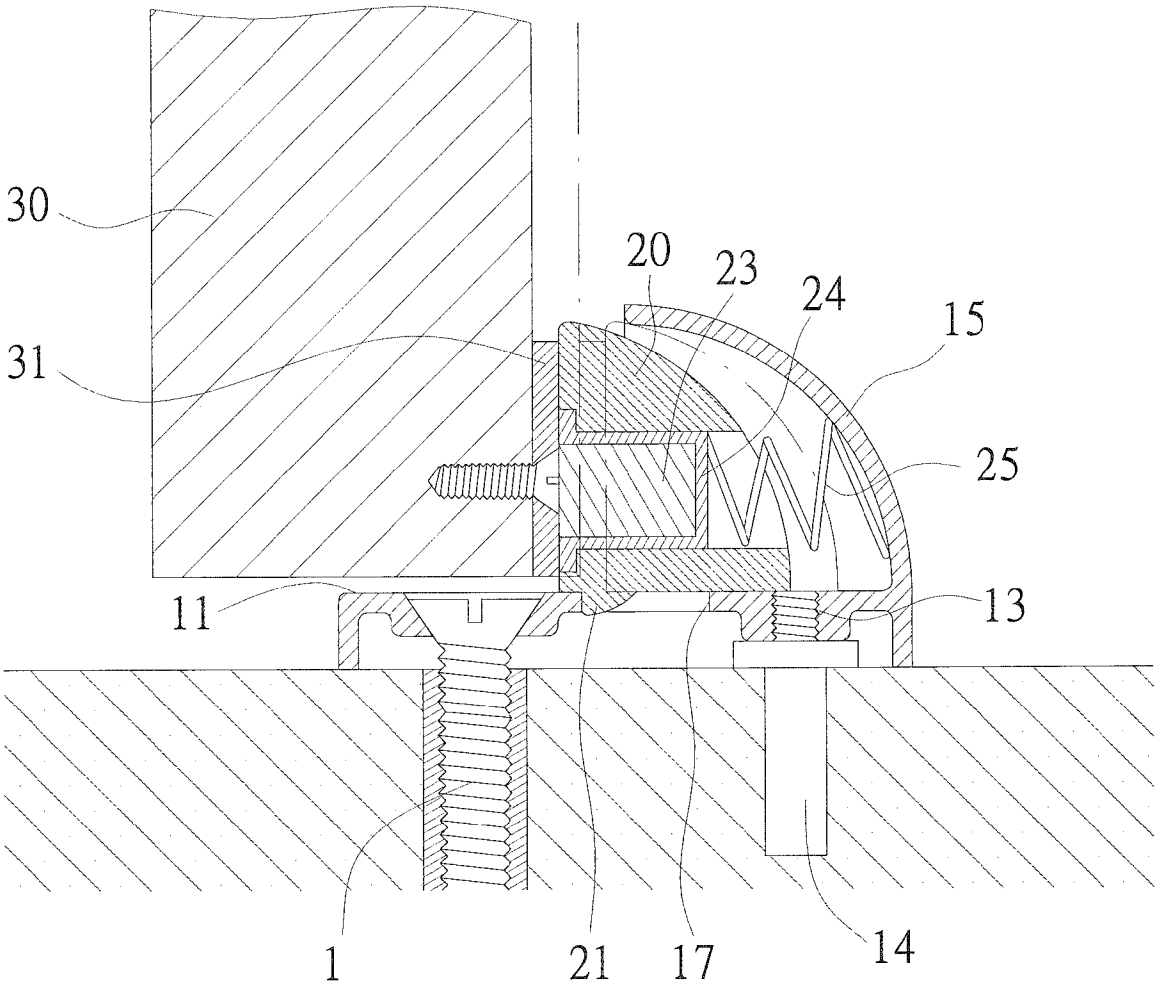
FIG. 4 is a schematic view showing an operating status of the preferred embodiment of the present invention.
Figure 5:
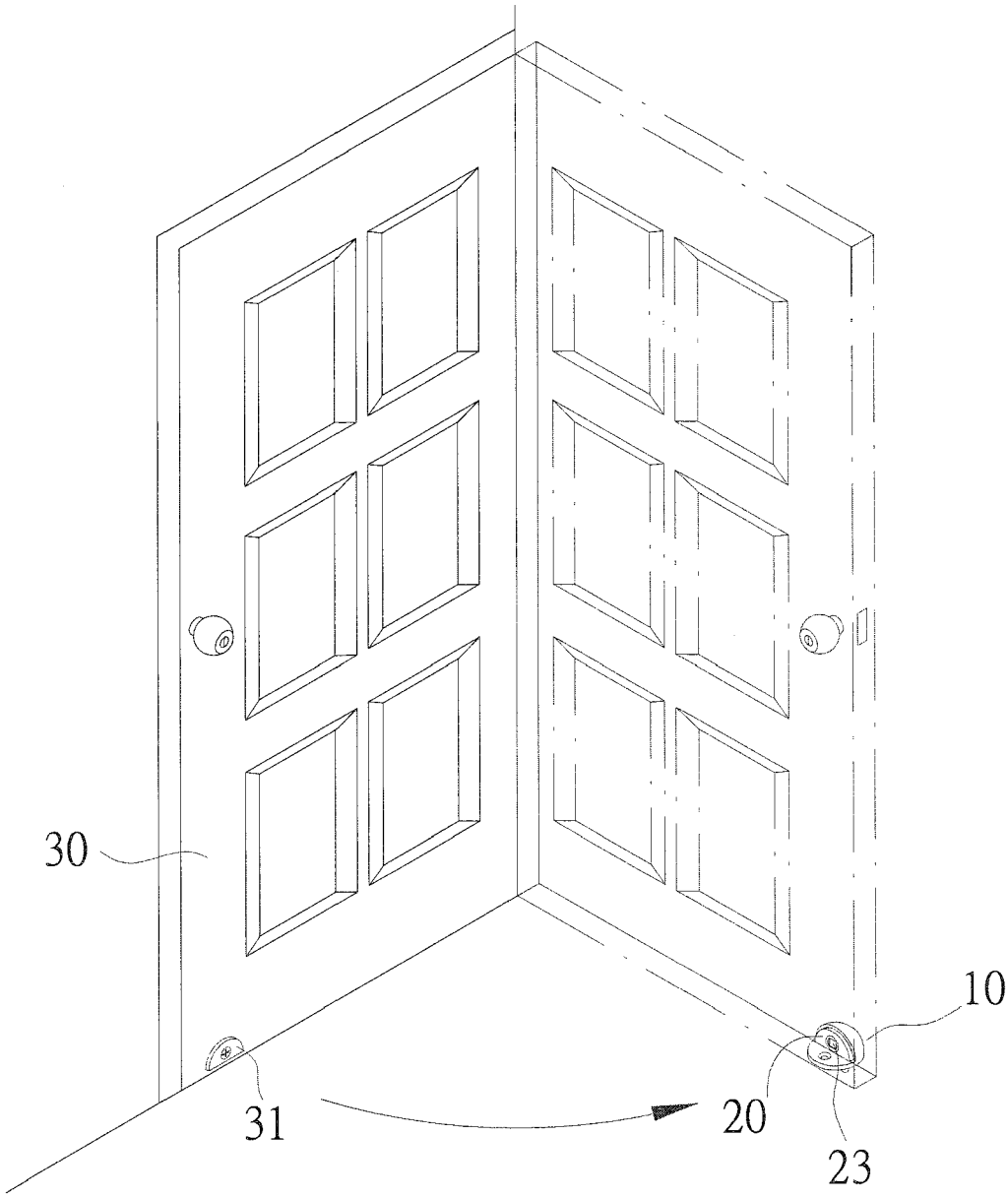
FIG. 5 is a schematic view showing a reference of an operating status of the preferred embodiment of the present invention.

Referring to FIGS. 1 through 5, a preferred embodiment of the present invention is comprised of a base (10) fixed to a floor. The base (10) contains a platform (11); a bolting hole (12) is disposed on the front section of the platform (11); a pinhole (13) inserted with a bolt (14) is disposed on the rear section of the platform (11); and both of the bolting hole (12) when inserted with another bolt (1) and the pinhole (13) inserted with the bolt (14) secure the base (10) to the floor. A quarter spherical retaining portion (15) in a shell form is disposed on the rear section of the platform (11) of the base (10) with an elevation of the retaining portion (15) to allow exposure of the bolting hole (12). A chamber (16) is defined under the retaining portion (15) with its front facing a door panel (30), and a guide trough (17) is disposed in front of the chamber (16). A buffer (20) made of a material providing absorption efficacy, e.g., rubber, plastic, or the equivalent, in the similar quarter spherical form is received in the chamber (16) of the retaining portion (15). A lateral insertion block (21) projects from the bottom of the buffer (20) at a position closer to the front edge of the buffer so that when the buffer (20) is received in the retaining portion (15), the lateral insertion block (21) is limited by the guide trough (17) and will not escape from the retaining portion (15) of the base (10) to prevent the buffer (20) from escaping out of the retaining portion (15) of the base (10). A through hole (22) is disposed at the center of the buffer (20). A magnetic member (23) is first put into a cap (24), and the cap (24) containing the magnetic member (23) is then inserted into the through hole (22) of the buffer (20) to define an attraction point at a position where the magnetic member (23) protrudes from the front of the buffer (20). Meanwhile, an elastic member is disposed in the rear section of the through hole (22) against the inner end of the magnetic member (23) so that the elastic member (25) is sandwiched by the buffer (20) and the inner wall of the retaining portion (15) of the base (10). Accordingly, the elastic member (25) pushes the buffer (20) to partially expose out of the chamber (16) of the base (10) while enabling the buffer (20) the buffer efficacy of reciprocal compression. Furthermore, if the door panel (30) is made of non-metal material, a metal locating plate (31) must be disposed at a lower corner on the back of the door and at the distal end from where the door panel (30) is hinged so to be attached to the magnetic member (23) and secured in position once the door is opened.

To assembly, the base (10) is fixed to the floor at where it meets the door panel (30) when opened by inserting the bolt (1) inserted into the bolting hole (12) disposed in the front section of the base (10) and the bolt (14) disposed below the rear section of the base (10); the buffer (20) received in the retaining portion (15) faces in the direction of the door panel (30), and the metal locating plate (31) is provided if the door panel (30) is made of non-metal material to complete the basic configuration of the preferred embodiment. Once the door panel (30) is opened and the locating plate (31) contacts the buffer (20) of the doorstop, the locating plate (31) is attracted by the magnetic member (23) disposed in the center of the buffer (20). The buffer (20) and the elastic member (25) behind the buffer (20) effectively absorb the impact created by the door panel (30) hitting the doorstop. Even the door is slammed to open, both of the buffer (20) and the elastic member (25) offset any excessive impact from the door, and the door panel (30) is prevented from bouncing back since the locating plate (31) is attached by attraction to the magnetic member (23) and secured in position. The door panel (30) is thus firmly attached to the doorstop to maintain well-facilitated access.

Figure 6:
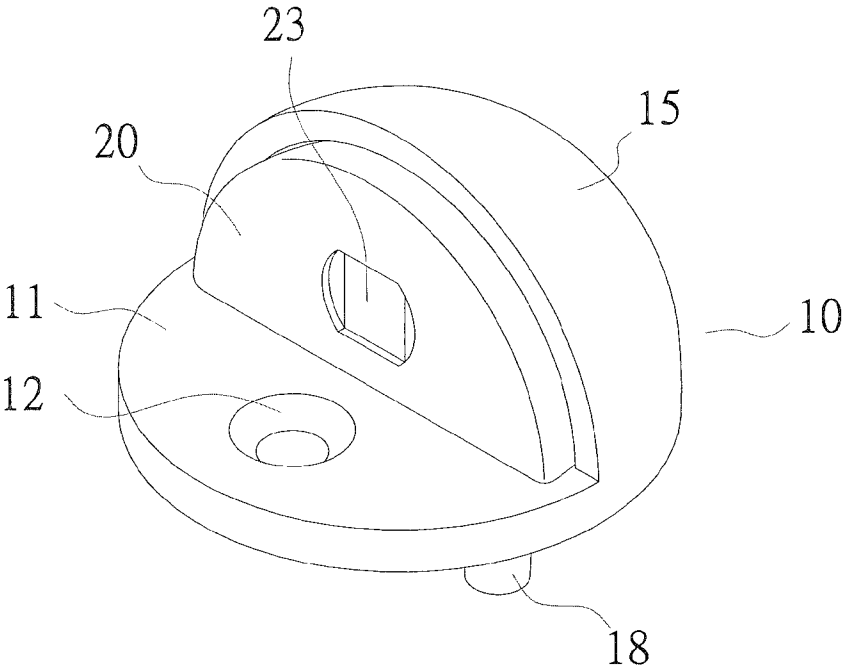
FIG. 6 is a schematic view showing a construction of another preferred embodiment of the present invention.
Figure 8:
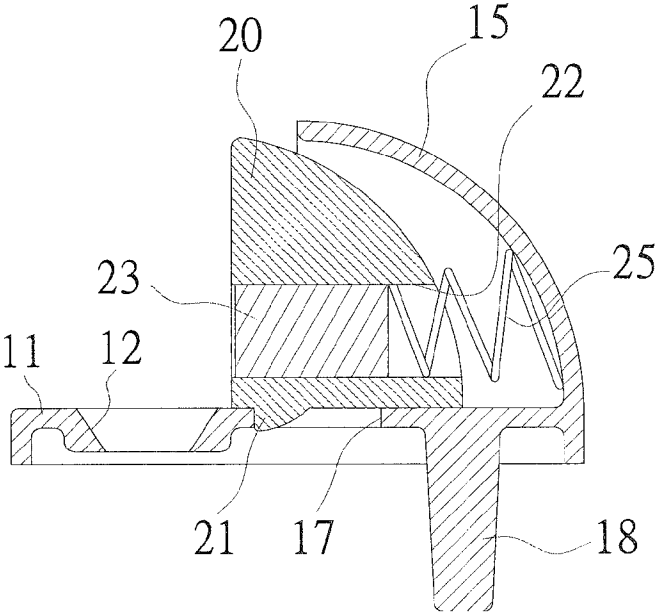
FIG. 8 is a schematic view showing structural relation among members of another preferred embodiment of the present invention.
Figure 7:
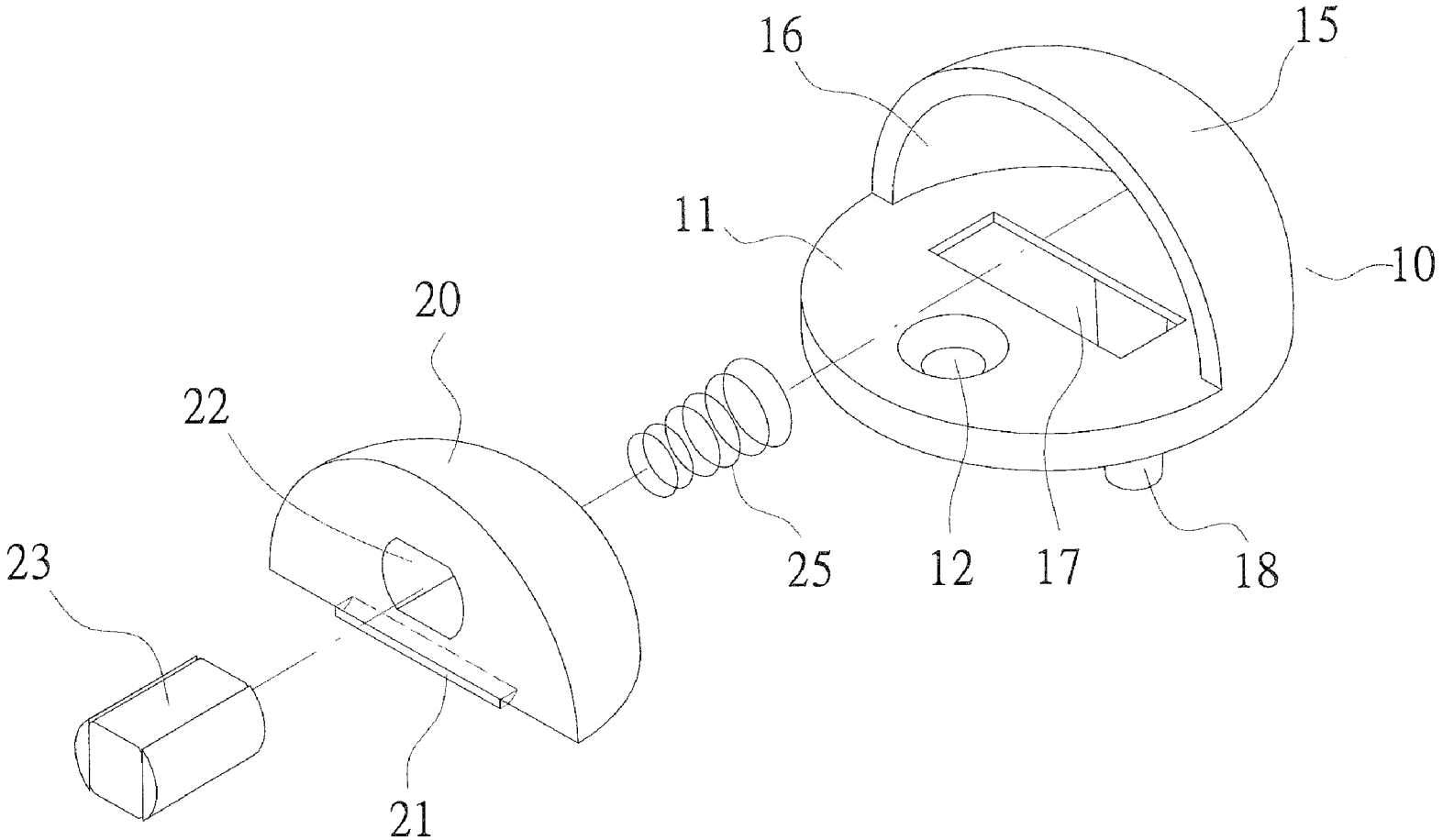
FIG. 7 is an exploded view of the construction of another preferred embodiment of the present invention.
Figure 9:
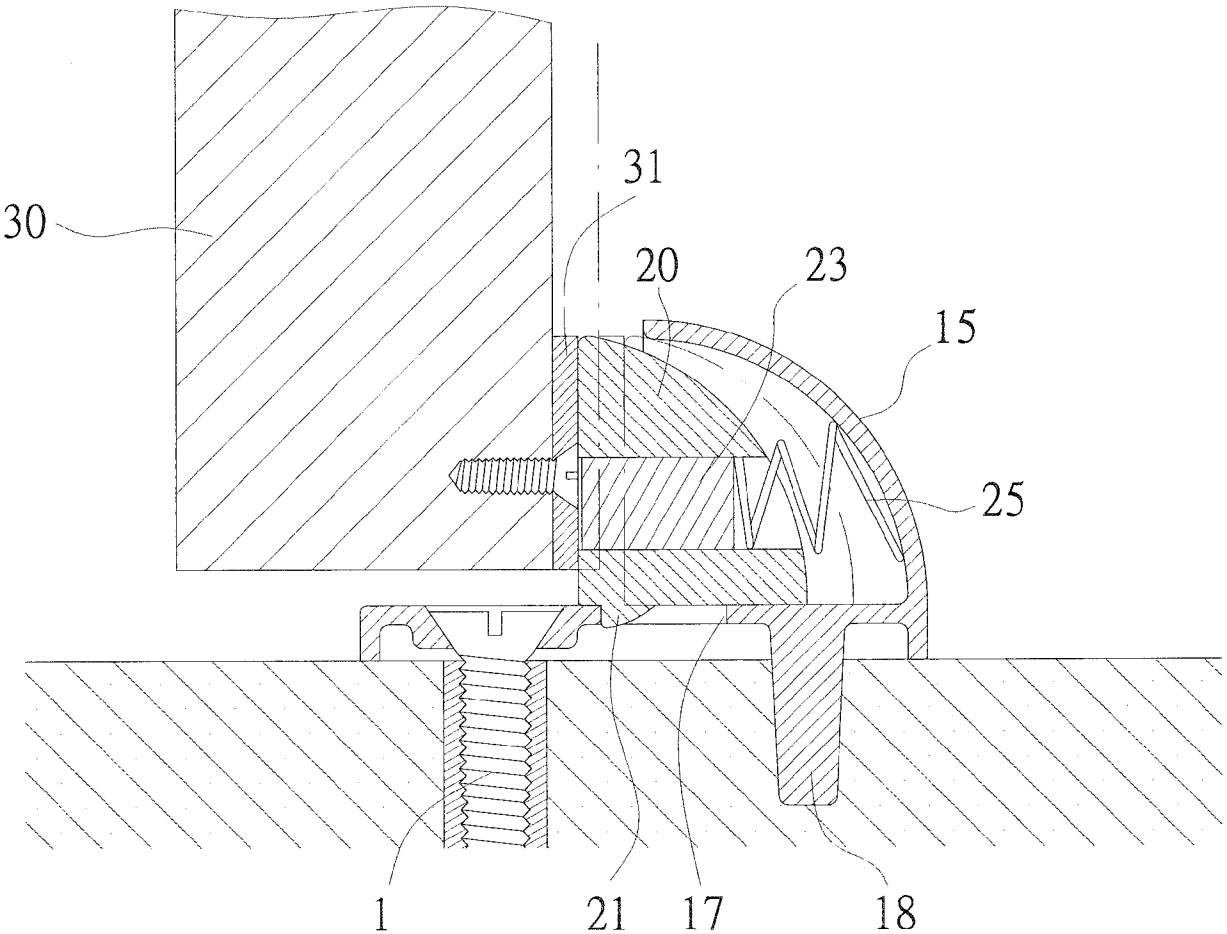
FIG. 9 is a schematic view showing an operating status of another preferred embodiment of the present invention.

Furthermore, as illustrated in FIGS. 6 through 9, another preferred embodiment of the present invention basically following the functional configuration of the preceding preferred embodiment is essentially comprised of a base (10) fixed to the floor. The bolting hole (12) is disposed on the front section of the platform (11) of the base (10), and a pin (18) extends from the rear section of the base (10) and is made an integral part of the base (10) so as to fix the base (10) to the floor in conjunction with the bolt (1) locked into the bolting hole (12). The chamber (16) defined under the retaining portion (15) provided on the rear section of the platform (11) of the base (10). The buffer (20) is inserted into the chamber (16), and a guide trough (17) is disposed at where closer to the opening of the chamber (16) of the retaining portion (15) to be engaged by the lateral insertion block (21) disposed at the lower edge of the buffer (20) and projecting from the front end of the buffer (20). The lateral insertion block (21) restricts the assembly relation between the buffer (20) and the retaining portion (15) so that when the buffer (20) exercises reciprocal motion, the magnetic member (23) is directly inserted into a through hole (22) disposed in the center of the buffer (20) in a shape comprising the shape of the magnetic member (23). The elastic member (25) is disposed in the rear section of the through hole (22) of the inner end of the magnetic member (23) to push the buffer (20) moving outwardly to partially expose out of the chamber (16) of the base (10) while enabling the buffer (20) to execute elastically reciprocal compression. Accordingly, once the door is opened and the door panel (30) contacts the buffer (20) of the doorstop, the door panel (30) is attached to the magnetic member (23) while both of the buffer (20) and the elastic member (25) absorb the offset the impact applied by the door panel (30) thus to prevent the door panel (30) from bouncing back to effectively maintain the door panel (30) in its open status for better achieving the purpose of securing the door panel (30) in position by the doorstop.

Figure 10:
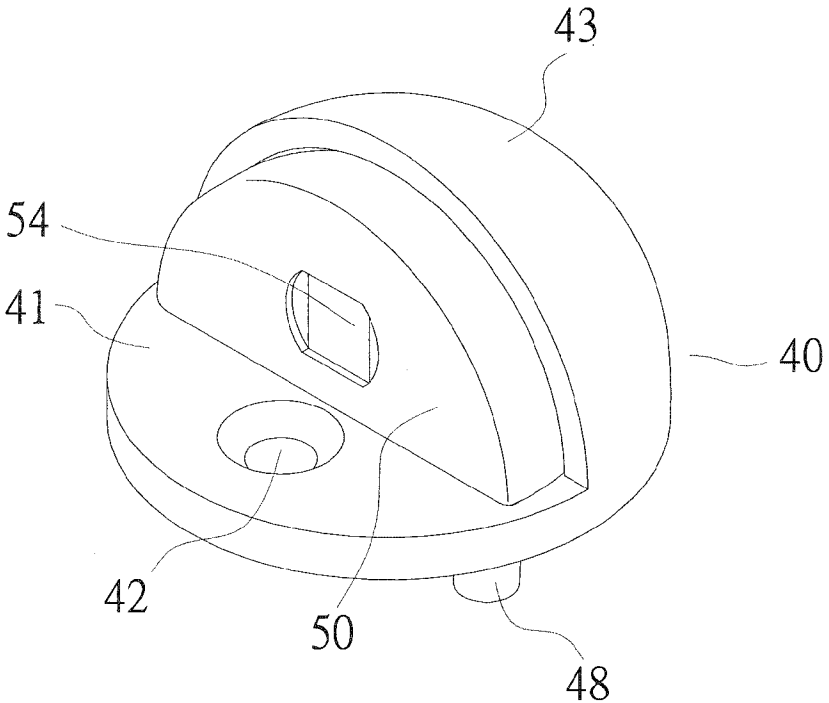
FIG. 10 is a schematic view showing a construction of another preferred embodiment yet of the present invention.
Figure 12:
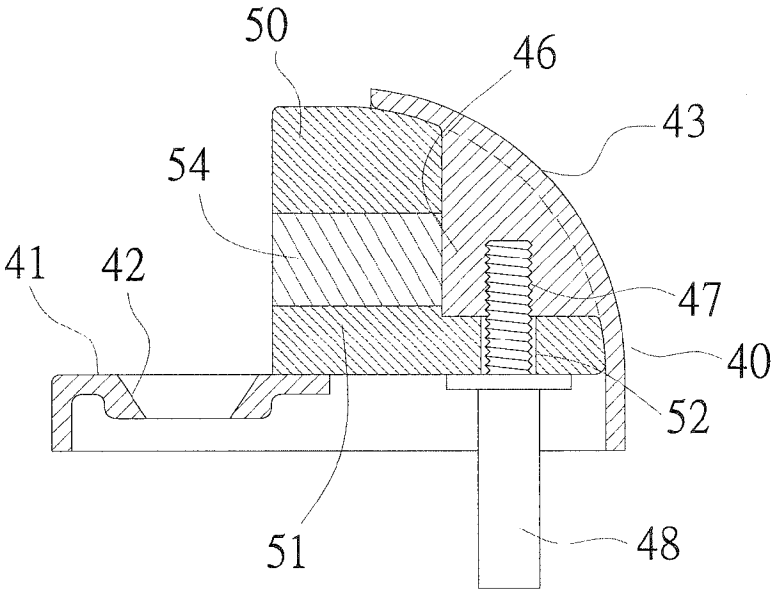
FIG. 12 is a schematic view showing structural relation among members of another preferred embodiment yet of the present invention.
Figure 11:
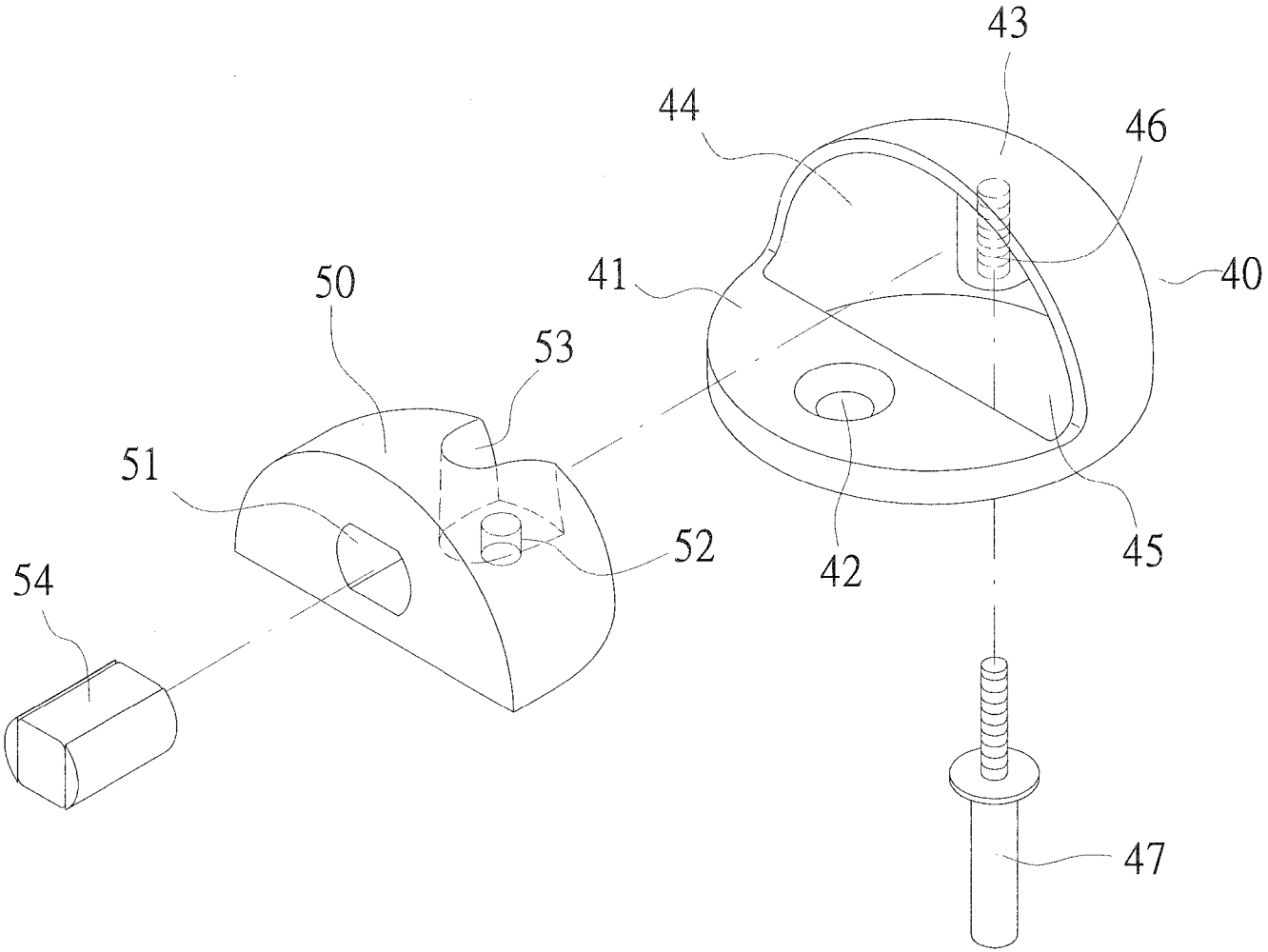
FIG. 11 is an exploded view of the construction of another preferred embodiment yet of the present invention.
Figure 13:
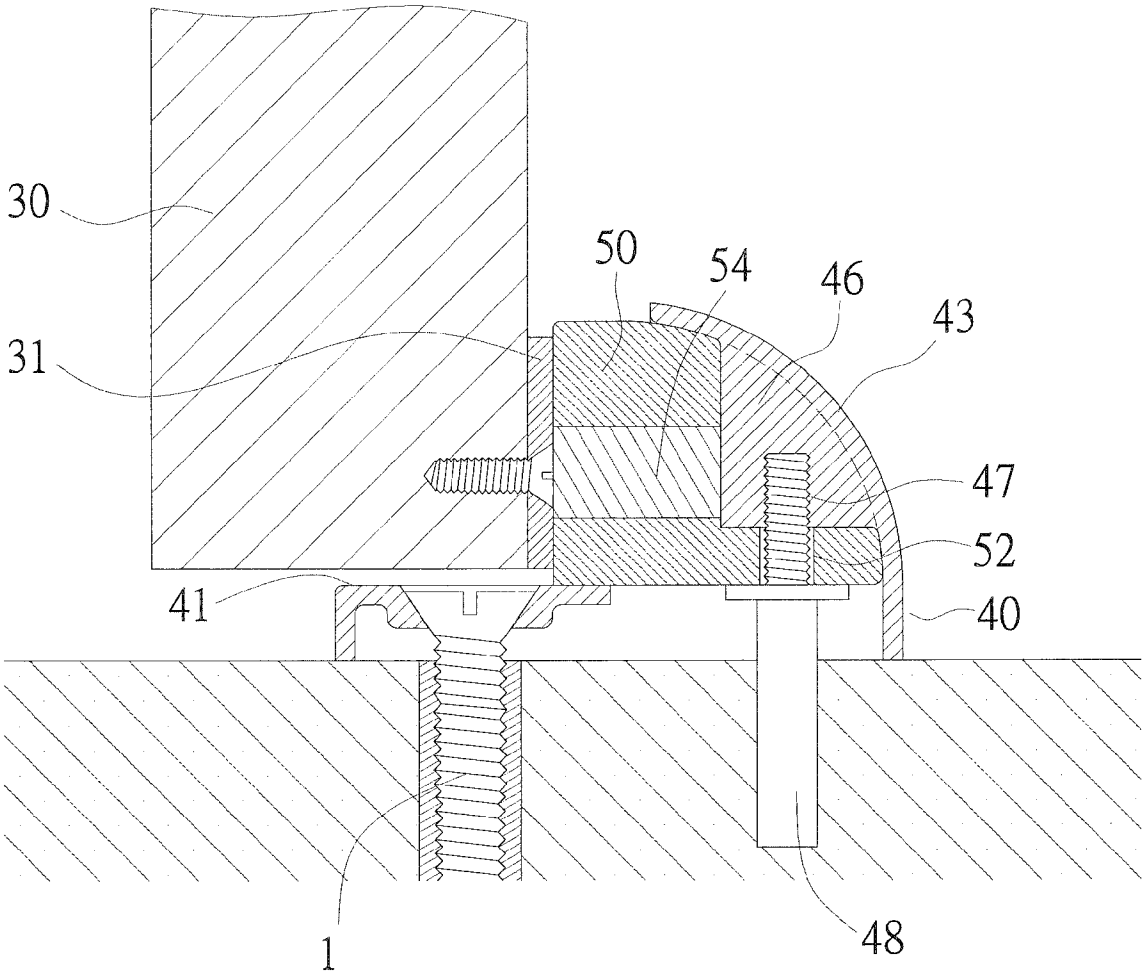
FIG. 13 is a schematic view showing that structural relation among members of another preferred embodiment yet of the present invention when a door is in its secured status.

Now referring to FIGS. 10 through 14, another preferred embodiment yet of the present invention essentially designed to meet positioning requirements simply by magnetism includes a base (40) fixed to the floor containing a platform (41). A bolting hole (42) is disposed to a predetermined location on the front section of the platform (41), and a shell-shaped quarter spherical retaining portion (43) is provided to the rear section of the platform (41) of the base (40). A chamber (44) is defined under the retaining portion (43) at where in relation to the front end of a door panel (60), and the bottom of the retaining portion (43) is fully hollowed to define a space (45). Deep into the inner edge of the retaining portion (43) extends a bolting pillar (46) provided with an internal screw hole (47) to be inserted by a bolt (48). A buffer (50) made of absorption material, e.g., rubber, plastic or the equivalent, in a shape compromising that of the chamber (44) is inserted through the chamber (44) into the retaining portion (43). A through hole (51) is disposed to the center of the buffer (50) and another through hole (52) is vertically disposed from the bottom in the rear of the buffer (50). Both of the through hole (51) at the center of the buffer (50) and the through hole (51) connect through each other to define a trap (53). Accordingly, when the buffer (50) is inserted into the retaining portion (43) of the base (40), the buffer (50) merely causes the bolting pillar (46) at the inner edge of the retaining portion (43) to be embedded in the trap (53) of the buffer (50) while the bolt (48) inserts into the through hole (52) at the bottom of the buffer (50) to be locked into the screw hole (47) of the bolting pillar (46) for the buffer (50) to be restricted by the bolt (48) and prevented from leaving the retaining portion (43). A magnetic member (54) is inserted into the through hole (51) at the center of the buffer (50) to attract the door panel (30) or the metal locating plate (31) when the door panel (30) is made of non-metal material when the door is opened for the door panel (30) to contact the buffer (50). The buffer (50) absorbs and offsets the impact applied by the door panel (30) for it to be firmly attached in position to maintain its open status.

The present invention provides elastic buffer results by a buffer and an elastic member to effectively absorb the impact applied by the door panel when opened; and further secures the door panel attached by magnetism in position to prevent possible bouncing back even when the door is slammed to open so as to allow safe and smooth access while allowing a simple construction of the doorstop yielding excellent industrial technique value and utility. Therefore, this patent application is duly filed accordingly.

The invention claimed is:

1. A doorstop to absorb and offset an impact applied by a door when the door is opened, and which automatically secures the door in position, comprising:

a base, including:

a platform, a bolting hole being disposed at a predetermined location in a front section of the platform, the bolting hole receiving a threaded fastener that secures the base to a floor; and a retaining portion disposed in a rear section of the platform, a chamber being defined by the retaining portion, a guide trough being disposed in the chamber and adjacent to the bolting hole;

a buffer inserted in the chamber, the buffer being made of an absorption material and having a lateral insertion block protruding from its lower edge, the lateral insertion block being received within the guide trough to confine the buffer within the retaining portion, a center of the buffer having a through hole;

a magnetic member inserted in the through hole; and an elastic member disposed in a rear section of the through hole and pressing against an inner end of the magnetic member, the elastic member being sandwiched between the buffer and an inner wall of the retaining portion of the base, the buffer being pushed by the elastic member to be partially exposed out of the chamber, the buffer being elastically reciprocal;

the magnetic member attracting the door when the door is opened, and both the elastic member and the buffer effectively absorbing and offsetting an impact applied by the door to prevent the door panel from bouncing back while maintaining the door in an open status.

2. The doorstop as claimed in claim 1, further comprising a cap, the magnetic member being first inserted into the cap before being inserted into the through hole at the center of the buffer.

3. The doorstop as claimed in claim 1, wherein the magnetic member is directly inserted into the through hole at the center of the buffer.

4. The doorstop as claimed in claim 1, wherein a pinhole is disposed in the rear section of the platform to receive insertion of a bolt to secure the doorstop to the floor in conjunction with the threaded fastener inserted into the bolting hole provided in the front section of the platform.

5. The doorstop as claimed in claim 1, wherein a pin pillar extends from the platform as an integral part of the platform in the rear section of the platform, the base being secured to the floor with the pin pillar in conjunction with the threaded fastener inserted into the bolting hole provided in the front section of the platform.

6. The doorstop as claimed in claim 1, further comprising a metal locating plate positionable on a back of the door panel.

* * * * *